US009969194B2

(12) United States Patent
Ishikawa et al.

(10) Patent No.: US 9,969,194 B2
(45) Date of Patent: May 15, 2018

(54) PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Masahiro Tsuchiya, Tokyo (JP); Yuji Yada, Tokyo (JP); Tatsuya Oguchi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/333,321

(22) Filed: Oct. 25, 2016

(65) Prior Publication Data

US 2017/0120645 A1 May 4, 2017

(30) Foreign Application Priority Data

Oct. 30, 2015 (JP) ..... 2015-215074

(51) Int. Cl.

| | |
|---|---|
| ***B41J 29/02*** | (2006.01) |
| ***B41J 2/32*** | (2006.01) |
| ***B41J 11/04*** | (2006.01) |
| ***B41J 15/04*** | (2006.01) |
| ***B41J 29/13*** | (2006.01) |

(52) U.S. Cl.

CPC ..... *B41J 29/02* (2013.01); *B41J 2/32* (2013.01); *B41J 11/04* (2013.01); *B41J 15/042* (2013.01); *B41J 29/13* (2013.01); *B41J 2202/31* (2013.01)

(58) Field of Classification Search

CPC . B41J 29/00; B41J 29/02; B41J 29/023; B41J 29/026; B41J 15/042; B41J 2/32; B41J 11/04; B41J 2202/31; B41J 2/325

See application file for complete search history.

(56) References Cited

U.S. PATENT DOCUMENTS

| | | | | |
|---|---|---|---|---|
| 6,744,457 | B2 | 6/2004 | Seino et al. | |
| 7,806,361 | B2 | 10/2010 | Sato et al. | |
| 8,585,304 | B2 | 11/2013 | Yokoyama | |
| 2002/0048479 | A1* | 4/2002 | Bryant | B41J 2/325 400/247 |
| 2011/0203467 | A1 | 8/2011 | Naito | |

FOREIGN PATENT DOCUMENTS

| | | |
|---|---|---|
| CN | 102189814 | 9/2011 |
| JP | H02-160558 | 6/1990 |
| JP | 2003-246104 | 9/2003 |
| JP | 2008-143004 | 6/2008 |
| JP | 2009-028910 | 2/2009 |

* cited by examiner

*Primary Examiner* — Kristal Feggins
(74) *Attorney, Agent, or Firm* — IPUSA, PLLC

(57) ABSTRACT

A printer includes a body, a lid, a hook, and an engaging part. The body includes a holder configured to accommodate recording paper. The lid is attached to the body to be opened and closed relative to the body. The hook is attached to one of the body and the lid. The engaging part is attached to the other of the body and the lid. The engaging part is accommodated in a recess formed in the hook when the lid is closed relative to the body.

10 Claims, 28 Drawing Sheets

PRINTER

CROSS-REFERENCE TO RELATED APPLICATION

The present application is based upon and claims the benefit of priority of Japanese Patent Application No. 2015-215074, filed on Oct. 30, 2015, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. Such printers perform printing on recording paper with a head while conveying the recording paper, and cut the recording paper with a cutter. The cutter includes a fixed blade and a movable blade that slides toward the fixed blade to cut the recording paper.

Such printers may include a printer body and a lid pivotably supported on the printer body. The lid is opened to allow a roll of recording sheet to be loaded into a paper holder of the printer body.

Reference may be made to, for example, Japanese Patent No. 2585769 and Japanese Laid-Open Patent Applications No. 2003-246104, No. 2009-28910, and No. 2008-143004 for related art.

SUMMARY OF THE INVENTION

According to an aspect of the present invention, a printer includes a body, a lid, a hook, and an engaging part. The body includes a holder configured to accommodate recording paper. The lid is attached to the body to be opened and closed relative to the body. The hook is attached to one of the body and the lid. The engaging part is attached to the other of the body and the lid. The engaging part is accommodated in a recess formed in the hook when the lid is closed relative to the body.

DESCRIPTION OF THE EMBODIMENTS

Figure 1:
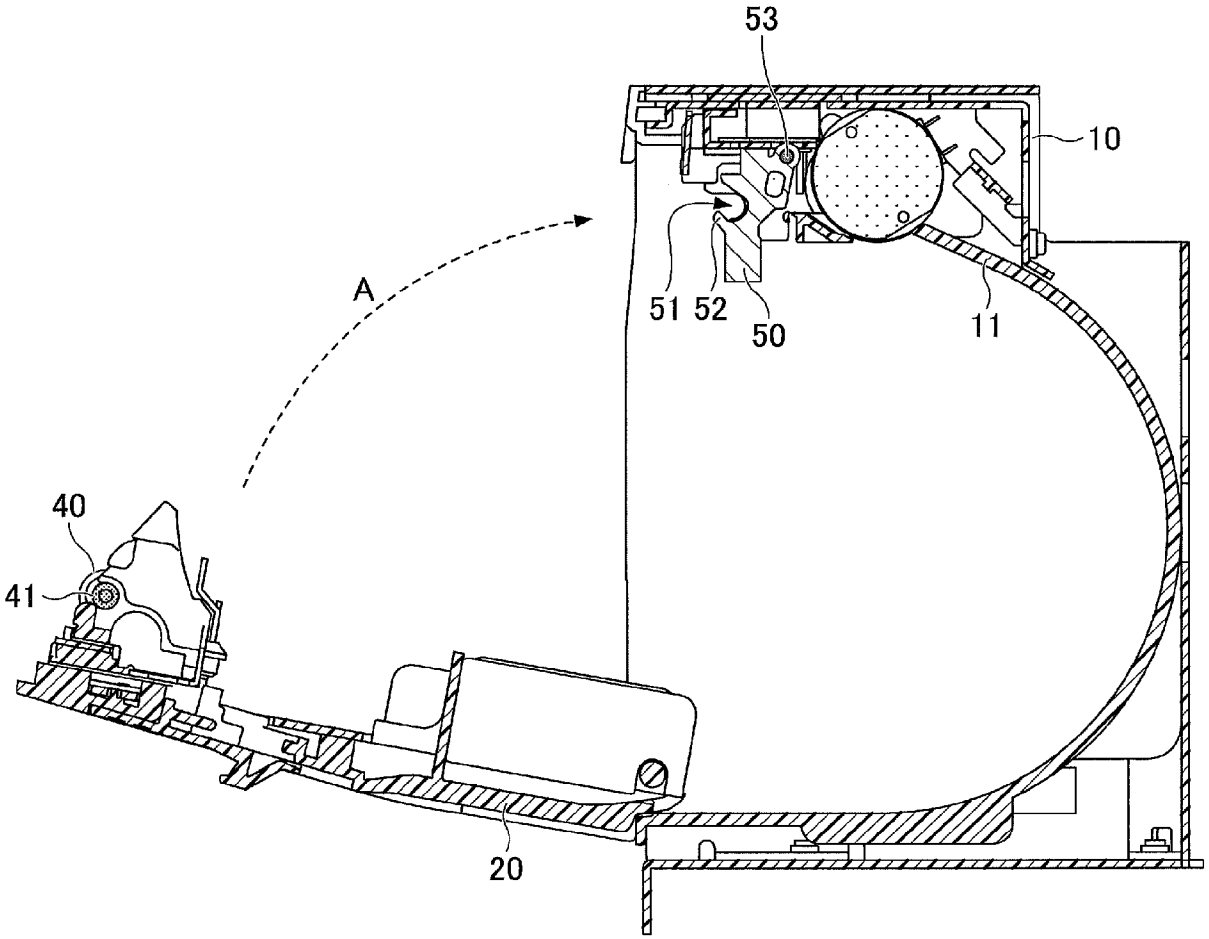
FIG. 1 is a diagram for explaining a clicking sensation accompanying the closure of a lid of a printer.

According to printers whose lid is opened to allow a roll of recording paper to be loaded into the paper holder, the lid is closed to make the recording paper set. When the lid is closed, a platen roller attached to the lid enters a platen lock attached to the printer body to hold the platen roller. At this point, the platen lock moves to provide a clicking sensation accompanying the closure of the lid.

A user can confirm the closure of the lid with this clicking sensation, but may not be sure whether the lid is closed if the clicking sensation is weak.

In this case, the user may believe that the lid is not closed although the lid is closed, and keep on pressing the lid hard, and as a result, the lid might be deformed or damaged. Furthermore, while the user believes that the lid is closed, printing cannot be performed if the lid is actually not closed.

A clicking sensation accompanying the entry of the platen roller into the platen lock which holds the platen roller is not so strong. Here, strengthening this clicking sensation may cause an unnecessary load to be applied onto the platen roller to deform or chip the platen roller, thus adversely affecting printing performed by the printer.

Therefore, there is a demand for printers that provide a clicking sensation sufficient for feeling the closure of the lid when the lid is closed.

According to an aspect of the present invention, it is possible to have a clicking sensation sufficient for feeling the closure of the lid of a printer when the lid is closed.

Embodiments of the present invention are described below with reference to the accompanying drawings. The same element is referred to using the same reference numeral, and a repetitive description thereof may be omitted.

First, a clicking sensation accompanying the closure of the lid in FIG. 1 is described with reference to FIGS. 1 through 4. Referring to FIG. 1, the printer includes a body 10 and a lid 20 that is attached to the body 10 to be pivotable about a shaft.

The body 10 includes a paper holder 11 ("holder 11"), a print head, two platen locks 50 that hold a platen roller 40, a control circuit board, and motors. The holder 11 is shaped to accommodate a roll of recording paper. The platen roller 40 is attached to the lid 20. The platen locks 50 are provided at positions corresponding to the axial ends of the platen roller 40 in the body 10. Only one of the platen locks 50 is depicted in FIGS. 1 through 4.

The recording paper is set in the printer by loading the roll into the holder 11 and closing the lid 20. Printing is performed on the recording paper held between the print head and the platen roller 40.

At the time of closing the lid 20, the open lid 20 is pivoted in the direction indicated by the dashed arrow A as depicted in FIG. 1. The platen lock 50 is attached to the body 10 to be pivotable about a shaft 53. An opening 51 that accommodates a platen shaft 41 of the platen roller 40 is formed in each platen lock 50. Each platen lock 50 includes a projection 52 provided at an edge of the opening 51. To each platen lock 50, a spring that exerts a restoring force to pivot the platen lock 50 clockwise about the shaft 53 is connected.

Figure 2:
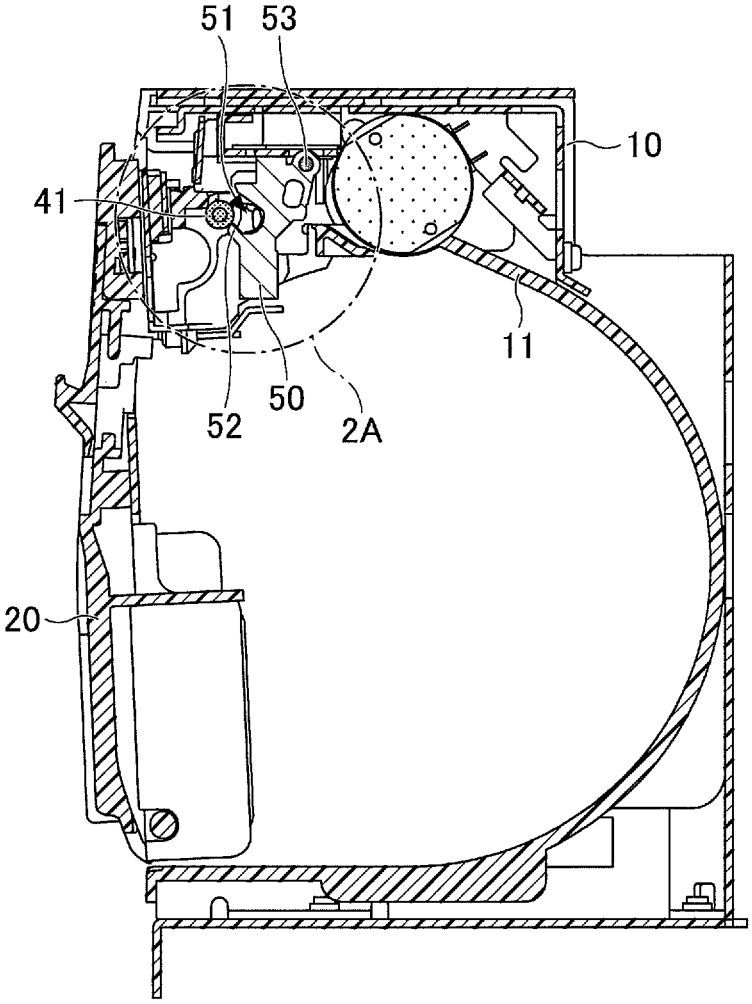
FIG. 2 is a diagram for explaining the clicking sensation accompanying the closure of the lid of the printer.
Figure 3A:
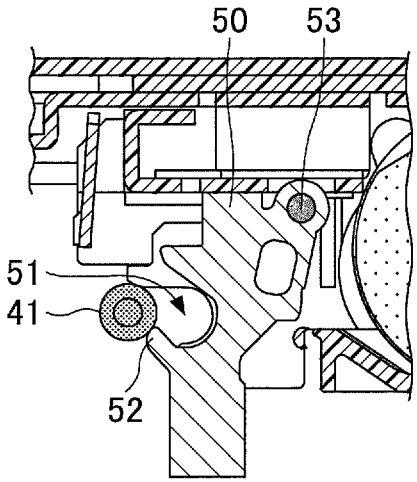
FIGS. 3A through 3C are diagrams for explaining the clicking sensation accompanying the closure of the lid of the printer.
Figure 3B:
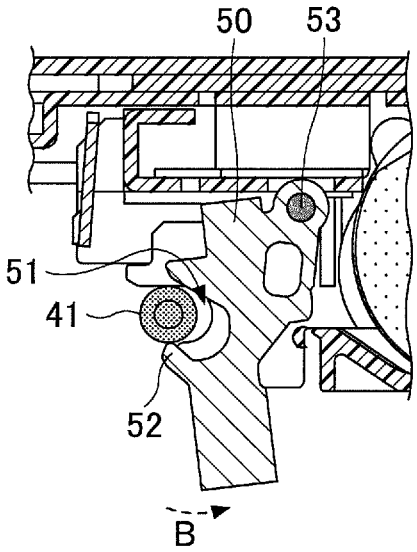
Figure 3C:
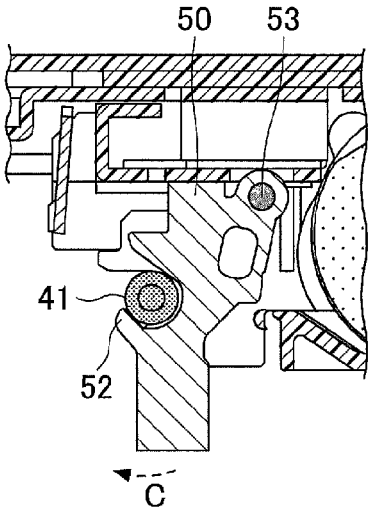
Figure 4:
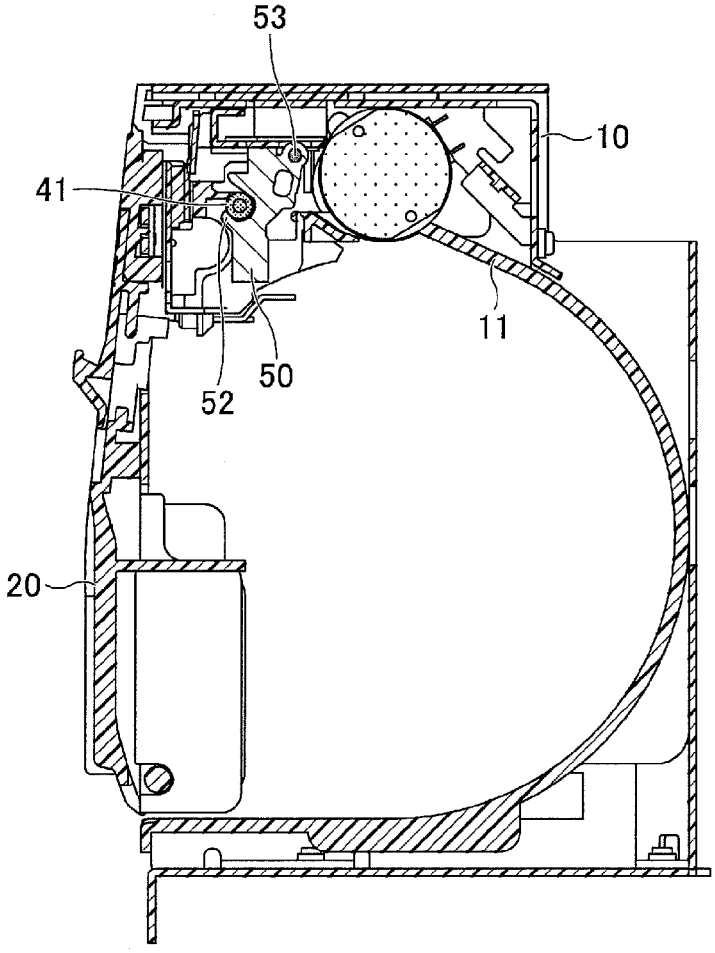
FIG. 4 is a diagram for explaining the clicking sensation accompanying the closure of the lid of the printer.

FIG. 2 depicts the state of the printer immediately before the lid 20 is closed. The following description is given, taking one of the platen locks 50 as an example. First, the platen shaft 41 contacts the projection 52 as depicted in FIG. 3A. FIG. 3A is an enlarged view of part of a region 2A encircled by the one-dot chain line in FIG. 2. When the lid 20 is further closed from the state depicted in FIG. 3A, the platen shaft 41 presses the platen lock 50 to pivot the platen lock 50 counterclockwise as indicated by the dashed arrow B in FIG. 3B. At this point, the platen shaft 41 moves along the surface of the platen lock 50 from the projection 52 to the opening 51. When the lid 20 is further closed from the state depicted in FIG. 3B, the platen shaft 41 enters the opening 51 as depicted in FIGS. 3C and 4. Because of the restoring force of the spring connected to the platen lock 50, the platen lock 50 pivots clockwise as indicated by the dashed arrow C to hold the platen shaft 41. A user can recognize the closure of the lid 20 with a clicking sensation produced when the platen lock 50 thus pivots clockwise.

The produced clicking sensation, however, may be weak because the restoring force of the spring connected to the platen lock 50 is not so strong.

Accordingly, it is desirable to strengthen the clicking sensation to ensure the user's recognition of the closure of the lid 20. When the restoring force of the spring is increased to strengthen the clicking sensation, however, a strong force is required to press the projection 52 with the platen shaft 41 to pivot the platen lock 50 counterclockwise as depicted in FIG. 3B. When the projection 52 is thus repeatedly pressed with a strong force with the platen shaft 41, the platen shaft 41 may deform or chip to degrade the printing performance of the printer.

Accordingly, there is a demand for printers that provide a sufficient clicking sensation without affecting the platen shaft 41 when the lid 20 is closed.

[a] First Embodiment

Next, a printer according to a first embodiment is described with reference to FIGS. 5 through 13B.

Figure 5:
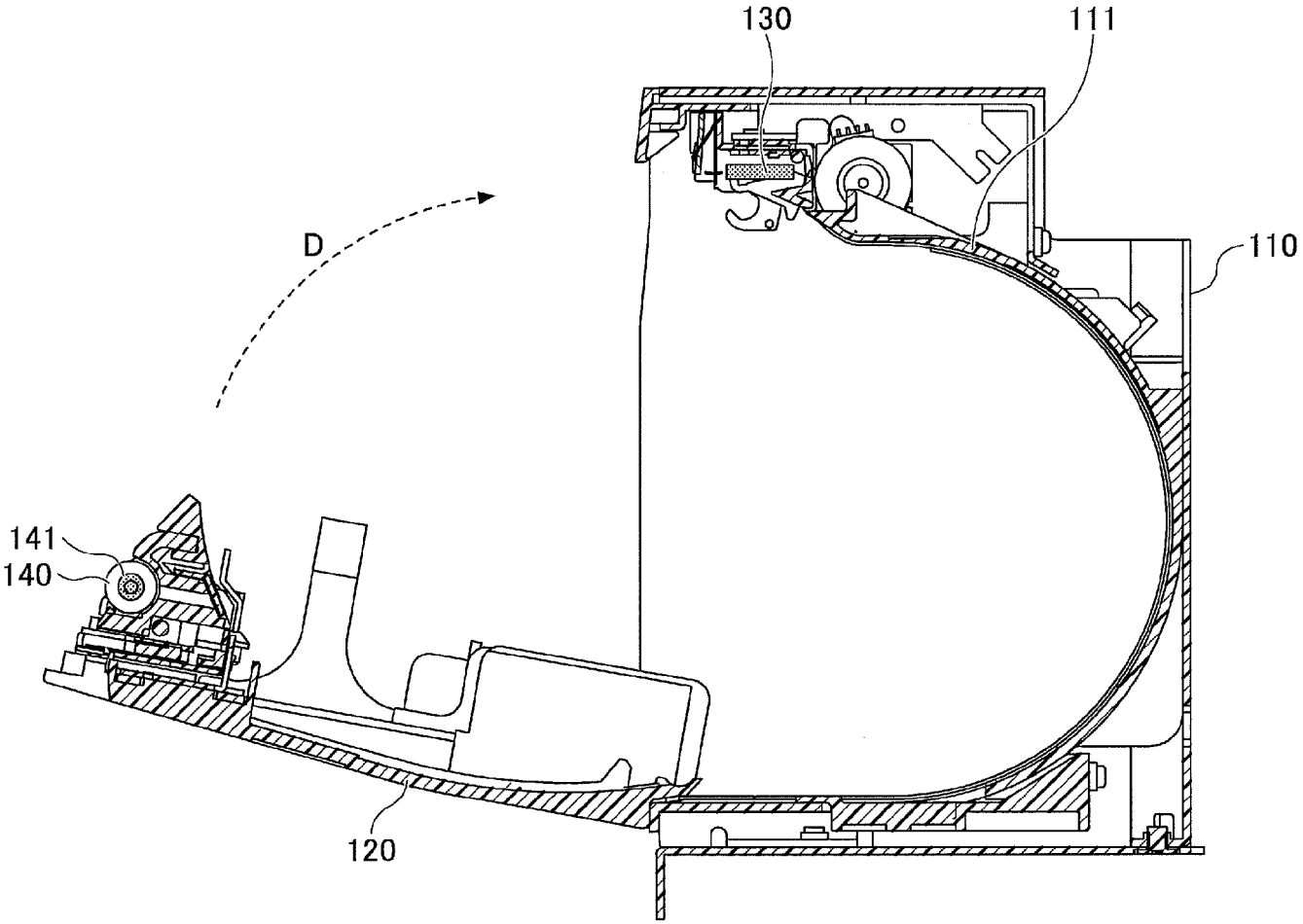
FIG. 5 is a diagram depicting a structure of a printer according to a first embodiment.
Figure 6:
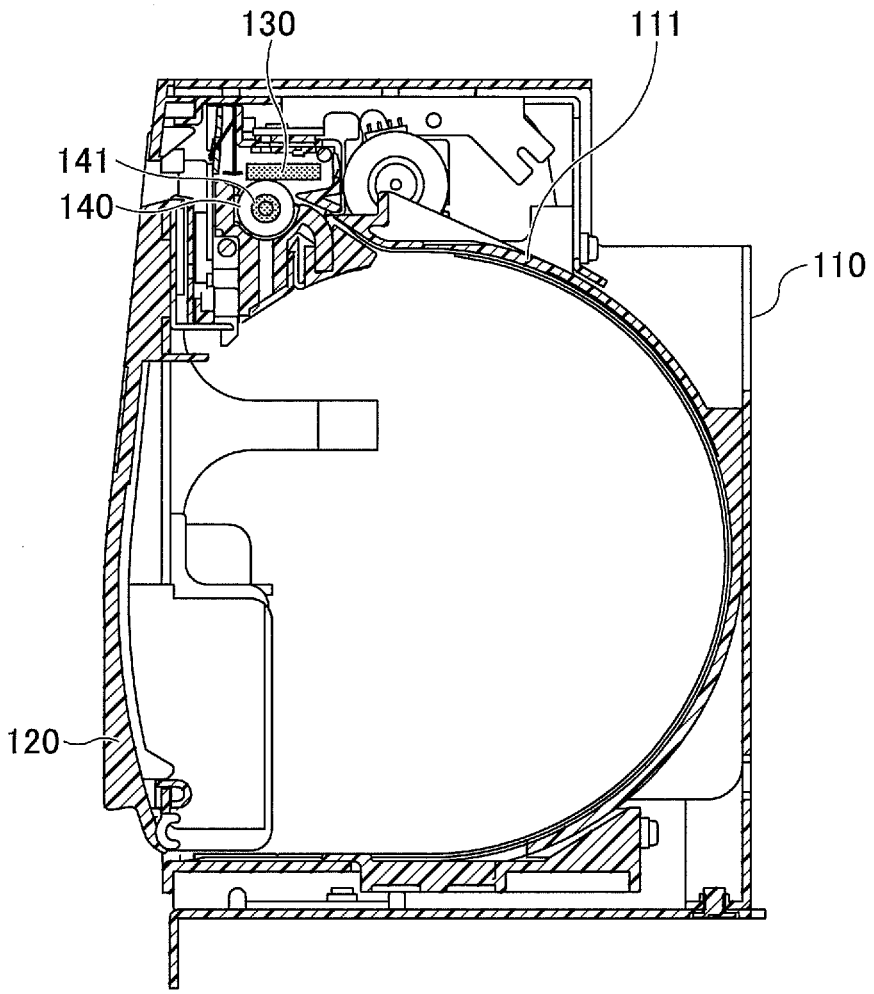
FIG. 6 is a diagram depicting the structure of the printer according to the first embodiment.
Figure 7:
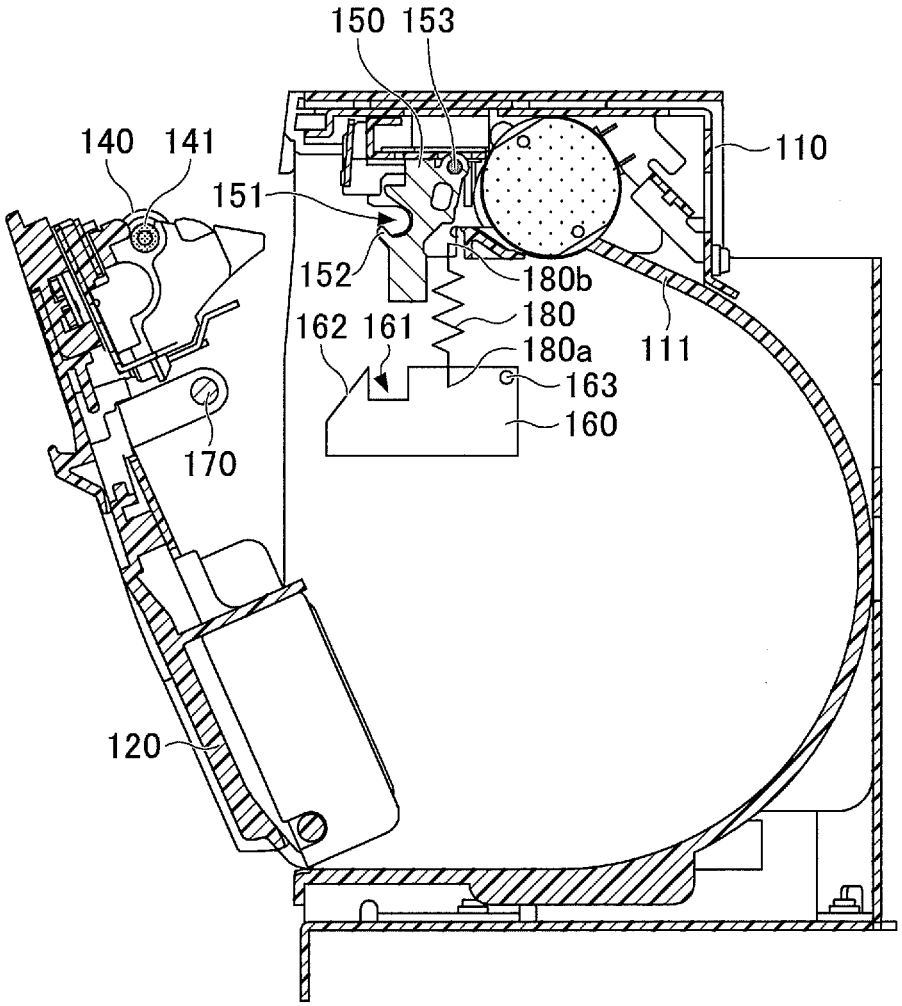
FIG. 7 is a diagram depicting the structure of the printer according to the first embodiment.

Referring to FIGS. 5 through 7, the printer according to this embodiment includes a body 110 and a lid 120 attached to the body 110 to be pivotable about a shaft. FIG. 5 is a cross-sectional view of the printer where the lid 120 is open. FIG. 6 is a cross-sectional view of the printer where the lid 120 is closed. FIG. 7 is a cross-sectional view of the printer where the lid 120 is in the process of being closed. The cross section of FIG. 7 and the cross sections of FIGS. 5 and 6 are taken along different planes.

The body 110 includes a paper holder 111 ("holder 111"), a print head 130 ("head 130") for printing on recording paper, two platen locks 150 configured to hold a platen roller 140, a hook 160, a fixed blade, a control circuit board, and motors. The head 130 is a thermal head. The holder 111 is shaped to accommodate a roll of recording paper that is dropped and loaded into the holder 111. The recording paper is thermal paper. The control circuit board is provided to control the printer. The motors include a motor for conveying the recording paper and a motor for driving a movable blade. The platen roller 140, a shaft 170 that serves as an engaging part, and a movable blade are attached to the lid 120. Alternatively, the platen roller 140 may be attached to the body 110, and the head 130 may be attached to the lid 120. When the platen roller 140 is attached to the body 110, the platen locks 150 are attached to the lid 120.

When the roll is loaded into the holder 111 and the lid 120 is closed, the recording paper becomes ready to be subjected to printing. The fixed blade and the movable blade slidable toward the fixed blade form a cutter to cut the recording paper.

The printer performs printing on the recording paper held between the head 130 and the platen roller 140. That is, the platen roller 140 rotates to convey the recording paper.

When the lid 120 is closed, the lid 120 is pivoted in the direction indicated by the dashed arrow D as depicted in FIG. 5. Referring to FIG. 7, the platen locks 150 are attached to the body 110 to be pivotable about a shaft 153. The platen locks 150 are provided at positions corresponding to the axial ends of the platen roller 140 in the body 110. Only one of the platen locks 150 is depicted in the drawings. An opening 151 that accommodates a platen shaft 141 of the platen roller 140 is formed in each platen lock 150. Each platen lock 150 includes a projection 152 formed at the edge of the opening 151. To each platen lock 150, a spring that exerts a restoring force to pivot the platen lock 150 clockwise is connected. The following description is given, taking one of the platen locks 150 as an example.

Referring to FIG. 7, the hook 160 is provided in the body 110. The hook 160 is connected to the body 110 to be pivotable about a shaft 163. A recess 161 is formed in the hook 160. The shaft 170 attached to the lid 120 enters the recess 161. The hook 160 includes a slope 162 formed on the lid 120 side of the recess 161, namely, on the opposite side of the recess 161 from the shaft 163. In other words, the slope 162 is positioned closer to the shaft 170 than the recess 161 when the lid 120 is open. A spring 180, which is a coil spring in FIG. 7, is provided between the hook 160 and the body 110. The coil spring 180 has a first end 180*a* connected to the hook 160 at a position between the shaft 163 and the recess 161, and a second end 180*b* connected to the body 110. The coil spring 180 exerts a restoring force in a direction to pivot the hook 160 clockwise about the shaft 163.

Figure 8:
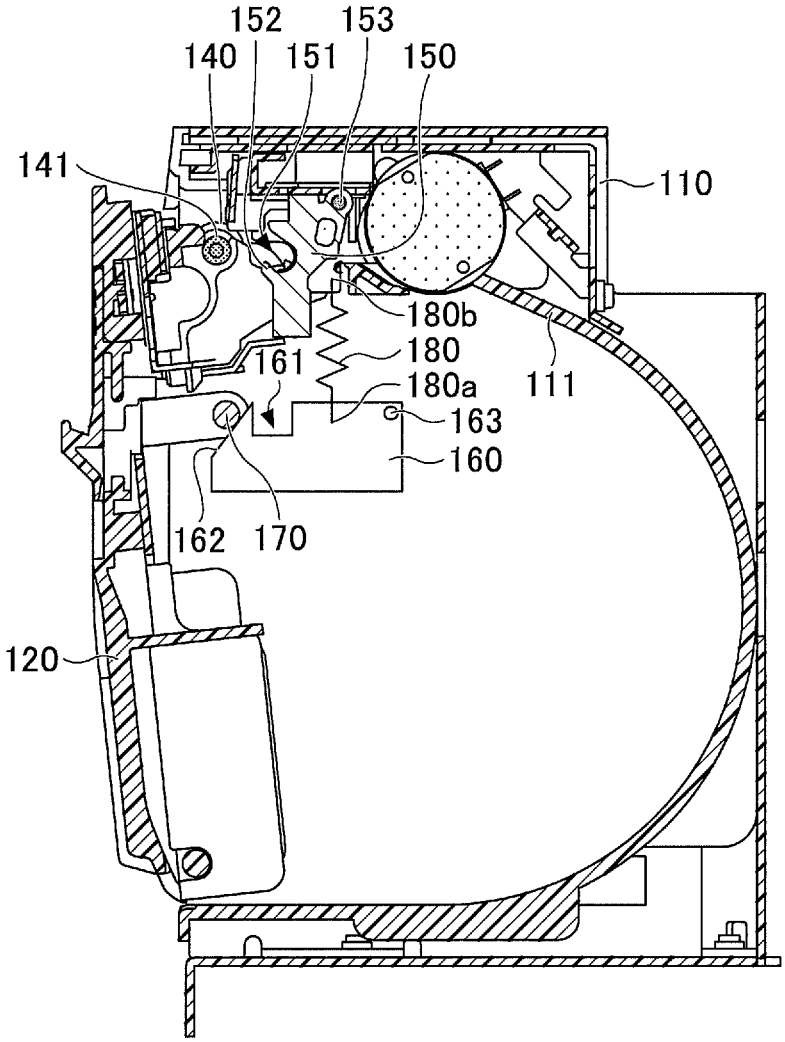
FIG. 8 is a diagram for explaining the printer according to the first embodiment.
Figure 9A:
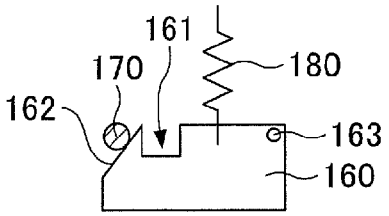
FIGS. 9A through 9D are diagrams for explaining the printer according to the first embodiment.

When the lid 120 is closed from the state depicted in FIG. 7, the lid 120 gets closer to the body 110 as depicted in FIG. 8, so that the shaft 170 contacts the slope 162 as depicted in FIG. 9A. In this state, the platen shaft 141 is out of contact with the platen lock 150.

Figure 9B:
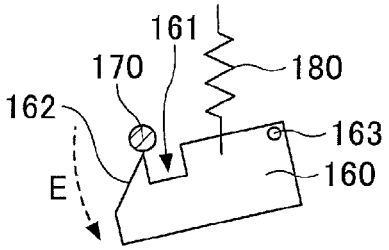

Thereafter, the lid 120 is further closed to cause the shaft 170 to press the hook 160 against the restoring force of the coil spring 180, so that the hook 160 pivots counterclockwise in the direction indicated by the dashed arrow E in FIG. 9B. At this point, the shaft 170 moves along the slope 162 to an end of the slope 162, namely, the boundary between the slope 162 and the recess 161 as depicted in FIG. 9B. The restoring force of the coil spring 180 maximizes when the shaft 170 is at the position illustrated in FIG. 9B.

Figure 9C:
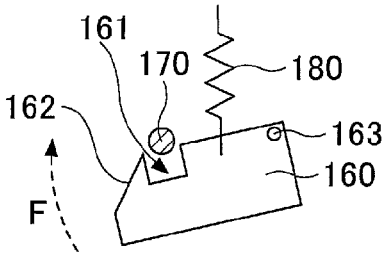
Figure 9D:
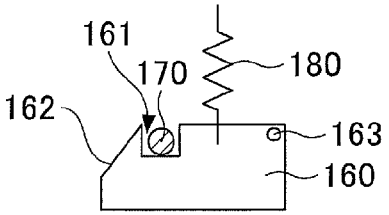
Figure 10:
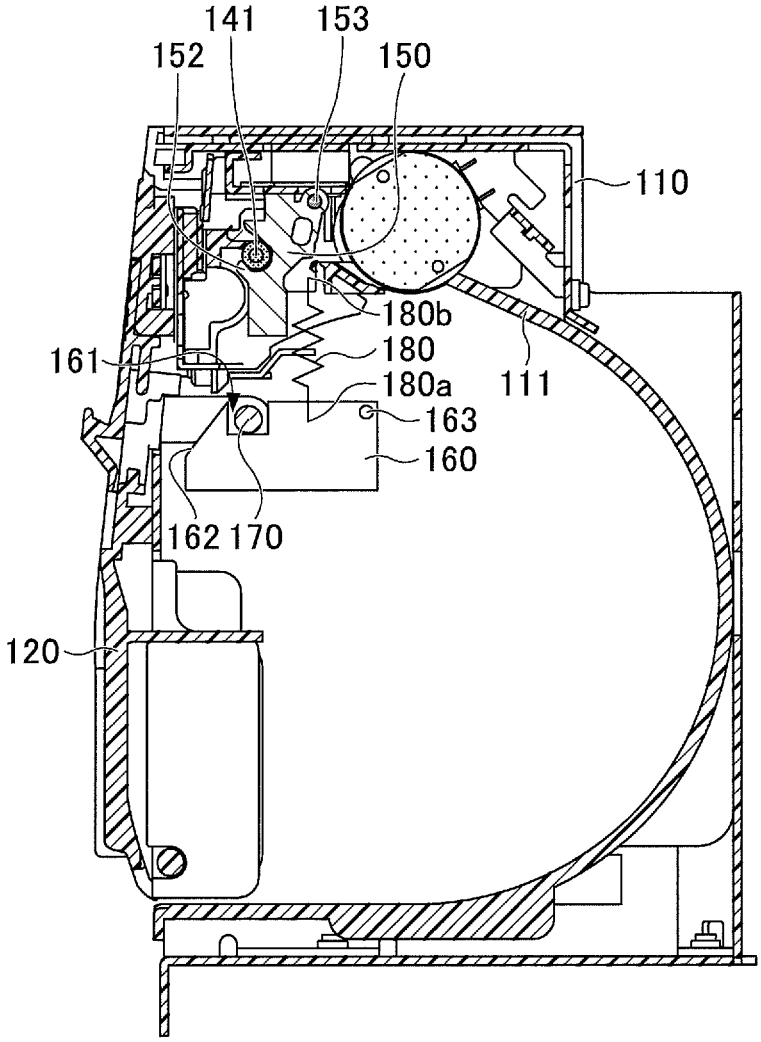
FIG. 10 is a diagram for explaining the printer according to the first embodiment.

Thereafter, the lid 120 is further closed to cause the shaft 170 to leave the slope 162 and move to a position facing the entrance of the recess 161 as depicted in FIG. 9C. As a result, the hook 160 pivots clockwise about the shaft 163 in the direction indicated by the dashed arrow F because of the restoring force of the coil spring 180. The hook 160 pivots until the shaft 170 contacts the bottom of the recess 161 as depicted in FIGS. 9D and 10. According to the printer of this embodiment, a strong clicking sensation can be produced at this point. In the state depicted in FIGS. 9D and 10, the shaft 170 is positioned in the recess 161, and the platen shaft 141 is positioned in the opening 151 to be held by the platen lock 150. The width of the recess 161 is greater than the thickness of the shaft 170 to ensure that the platen shaft 141 is held by the platen lock 150 when the shaft 170 enters the recess 161.

Unlike the platen roller 140, the shaft 170 is not used to convey recording paper. Therefore, pressing the slope 162 with a strong force with the shaft 170 does not cause any trouble in printing. Accordingly, it is possible to increase the restoring force of the coil spring 180 and to control the strength of the clicking sensation to a desired level.

Figure 11:
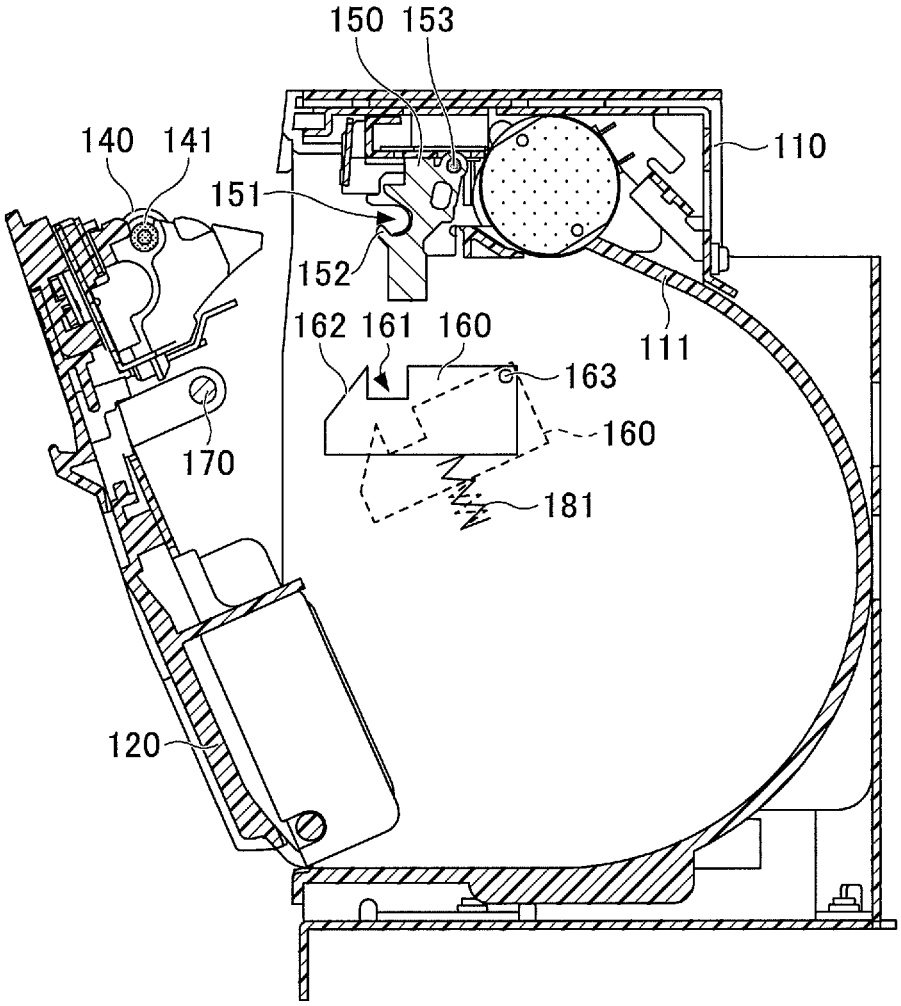
FIG. 11 is a diagram depicting another structure of the printer according to the first embodiment.

The above description is given of the case where the tension coil spring 180 is connected to the top of the hook 160. Alternatively, in place of the tension coil spring 180, a compression coil spring 181 may be connected to the bottom of the hook 160 as depicted in FIG. 11. In this case as well, the coil spring 181 exerts a spring force to pivot the hook 160 clockwise about the shaft 163. In FIG. 11, the dashed line indicates a position to which the hook 160 is pressed to pivot by the shaft 170.

Figure 12:
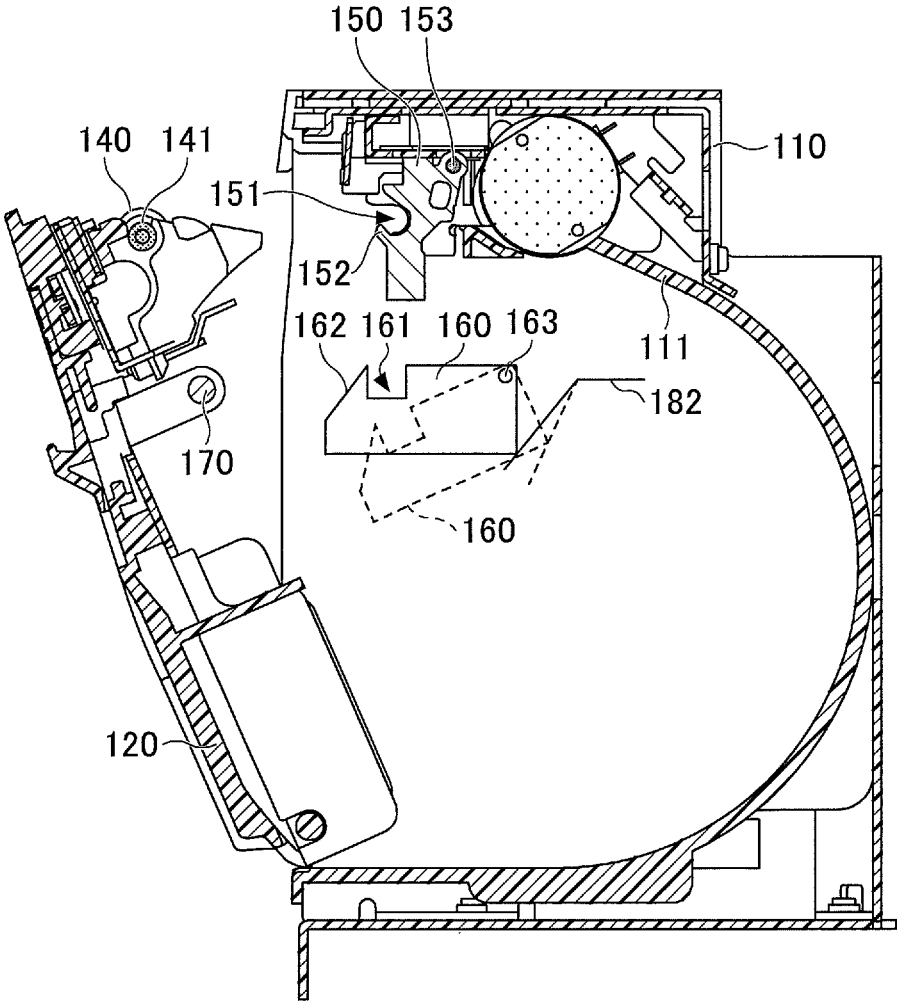
FIG. 12 is a diagram depicting yet another structure of the printer according to the first embodiment.

As yet another alternative, a leaf spring 182 may be provided in place of the coil spring 181 as depicted in FIG. 12. In this case as well, the spring 182 exerts a restoring force to pivot the hook 160 clockwise. In FIG. 12, the dashed line indicates a position to which the hook 160 is pressed by the shaft 170.

Figure 13A:
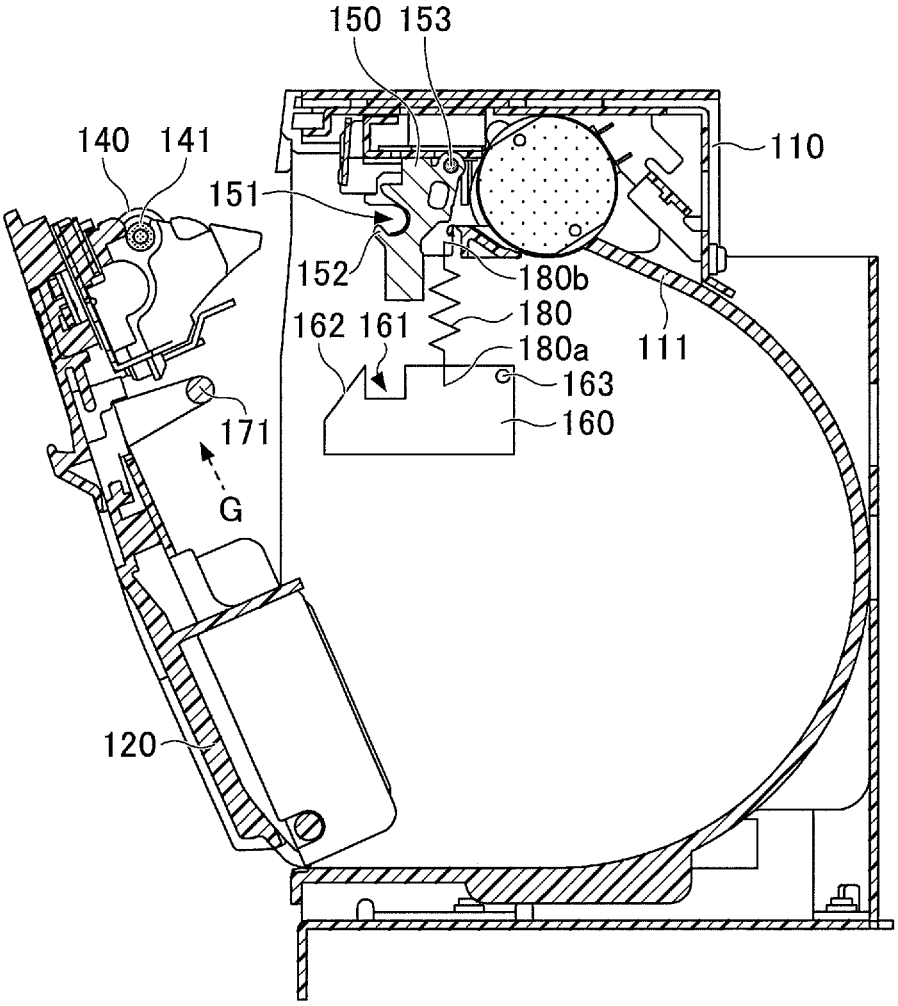
FIGS. 13A and 13B are diagrams depicting still another structure of the printer according to the first embodiment.
Figure 13B:
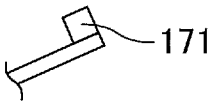

Furthermore, in place of the shaft 170, a projection 171 to serve as an engaging part may be attached to the lid 120 as depicted in FIGS. 13A and 13B. FIG. 13A is a cross-sectional view of the printer in which the projection 171 is provided on the lid 120. FIG. 13B is a view of the projection 171 taken in the direction indicated by the dashed arrow G in FIG. 13A. In the case of using the projection 171 as an engaging part as well, it is possible to produce the same effect as in the case of using the shaft 170.

[b] Second Embodiment

Figure 14:
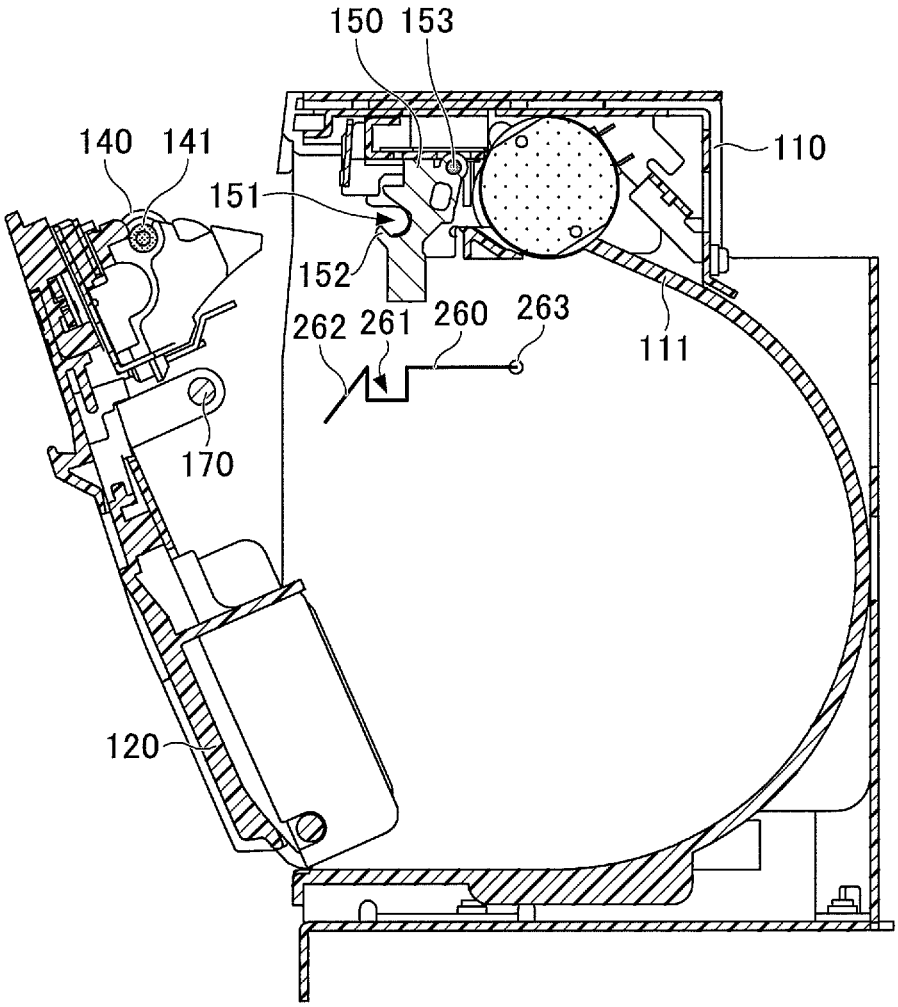
FIG. 14 is a diagram depicting a structure of a printer according to a second embodiment.

Next, a printer according to a second embodiment is described with reference to FIGS. 14 through 17. Referring to FIG. 14, the printer according to this embodiment includes a leaf spring hook 260 provided in the body 110. The hook 260 is fixed to the body 110 at a support 263. The hook 260 has the functions of both the hook 160 and the coil spring 180 of the first embodiment. The hook 260 is formed of a material having a spring property. Therefore, according to this embodiment, the coil spring 180 is not employed. A recess 261 that accommodates the shaft 170 is formed in the hook 260. The hook 260 includes a slope 262 formed on the lid 120 side of the recess 261, namely, on the opposite side of the recess 261 from the support 263. In other words, the slope 262 is positioned closer to the shaft 170 than the recess 261 when the lid 120 is open.

Figure 15:
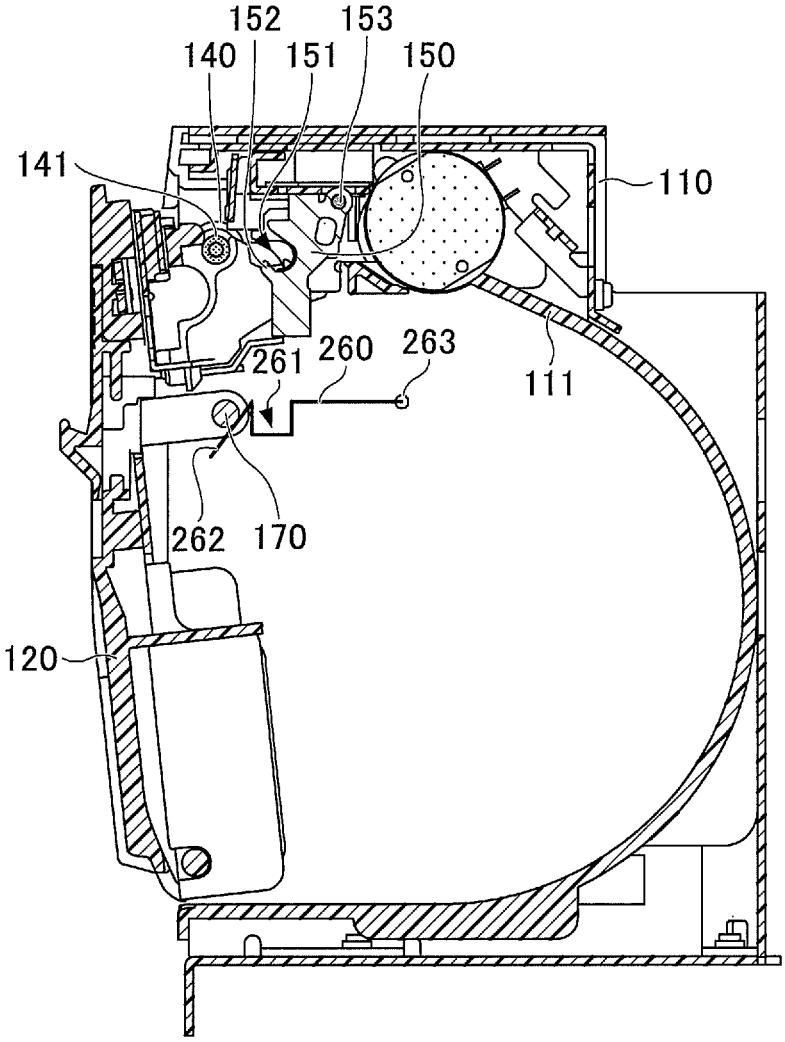
FIG. 15 is a diagram for explaining the printer according to the second embodiment.
Figure 16A:
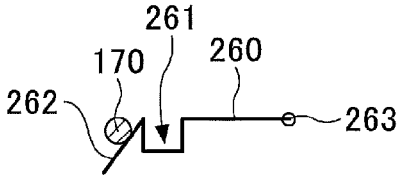
FIGS. 16A through 16D are diagrams for explaining the printer according to the second embodiment.

When the lid 120 is closed from the state depicted in FIG. 14, the lid 120 gets closer to the body 110 as depicted in FIG. 15, so that the shaft 170 contacts the slope 262 as depicted in FIG. 16A. In this state, the platen shaft 141 is out of contact with the platen lock 150.

Figure 16B:
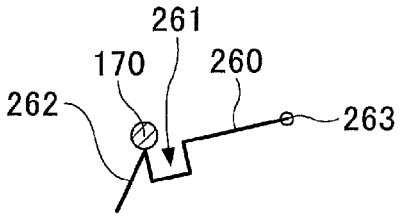

Thereafter, the lid 120 is further closed to cause the shaft 170 to press the hook 260 against its restoring force, so that the hook 260 flexes as depicted in FIG. 16B. At this point, the shaft 170 moves along the slope 262 to the boundary between the slope 262 and the recess 261 as depicted in FIG. 16B. The restoring force of the hook 260 maximizes when the shaft 170 is at the position illustrated in FIG. 16B.

Figure 16C:
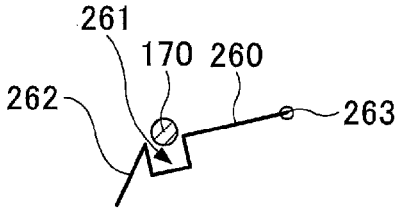
Figure 16D:
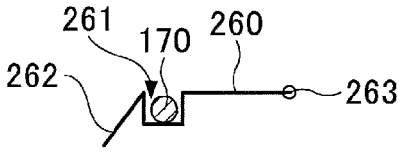
Figure 17:
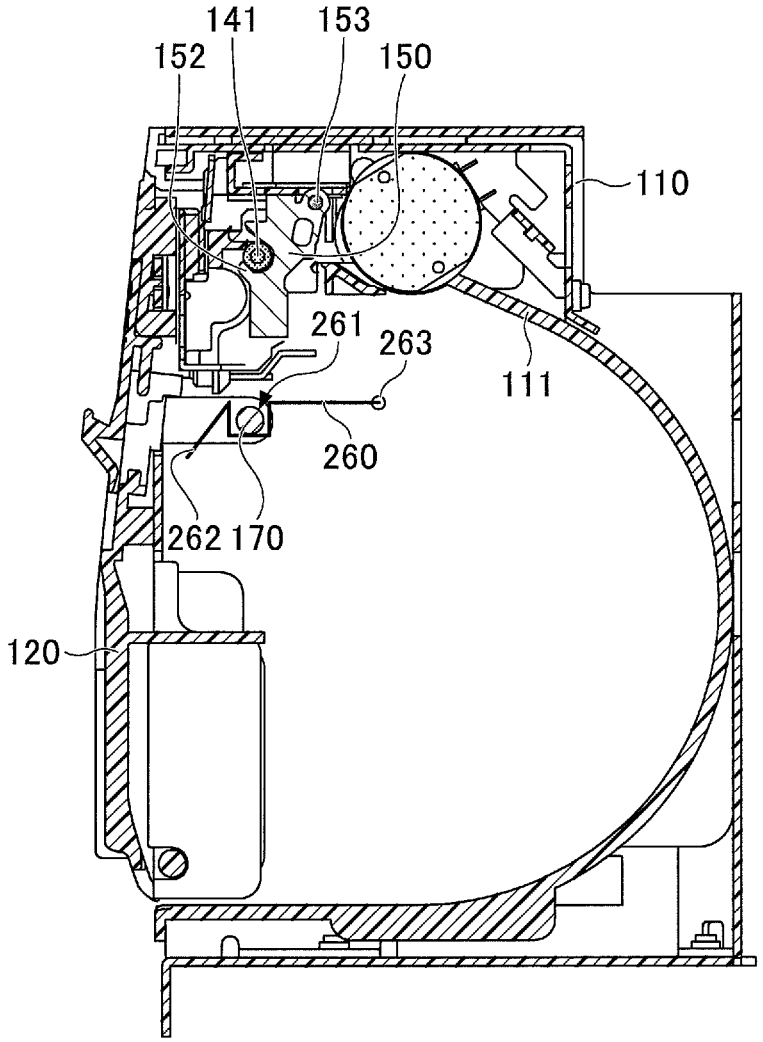
FIG. 17 is a diagram for explaining the printer according to the second embodiment.

Thereafter, the lid 120 is further closed to cause the shaft 170 to leave the slope 262 and move to a position facing the entrance of the recess 261 as depicted in FIG. 16C. As a result, the hook 260 returns to its original state because of its restoring force, so that the shaft 170 contacts the bottom of the recess 261 as depicted in FIGS. 16D and 17. According to the printer of this embodiment, a strong clicking sensation can be produced at this point. In the state depicted in FIGS. 16D and 17, the shaft 170 is positioned in the recess 261, and the platen shaft 141 is positioned in the opening 151 to be held by the platen lock 150.

Unlike the platen roller 140, the shaft 170 is not used to convey recording paper. Therefore, pressing the slope 262 with a strong force with the shaft 170 does not cause any trouble in printing. Accordingly, it is possible to strengthen the spring property of the hook 260 and to control the strength of the clicking sensation to a desired level.

In other respects than those described above, the second embodiment may be the same as the first embodiment.

[c] Third Embodiment

Figure 18:
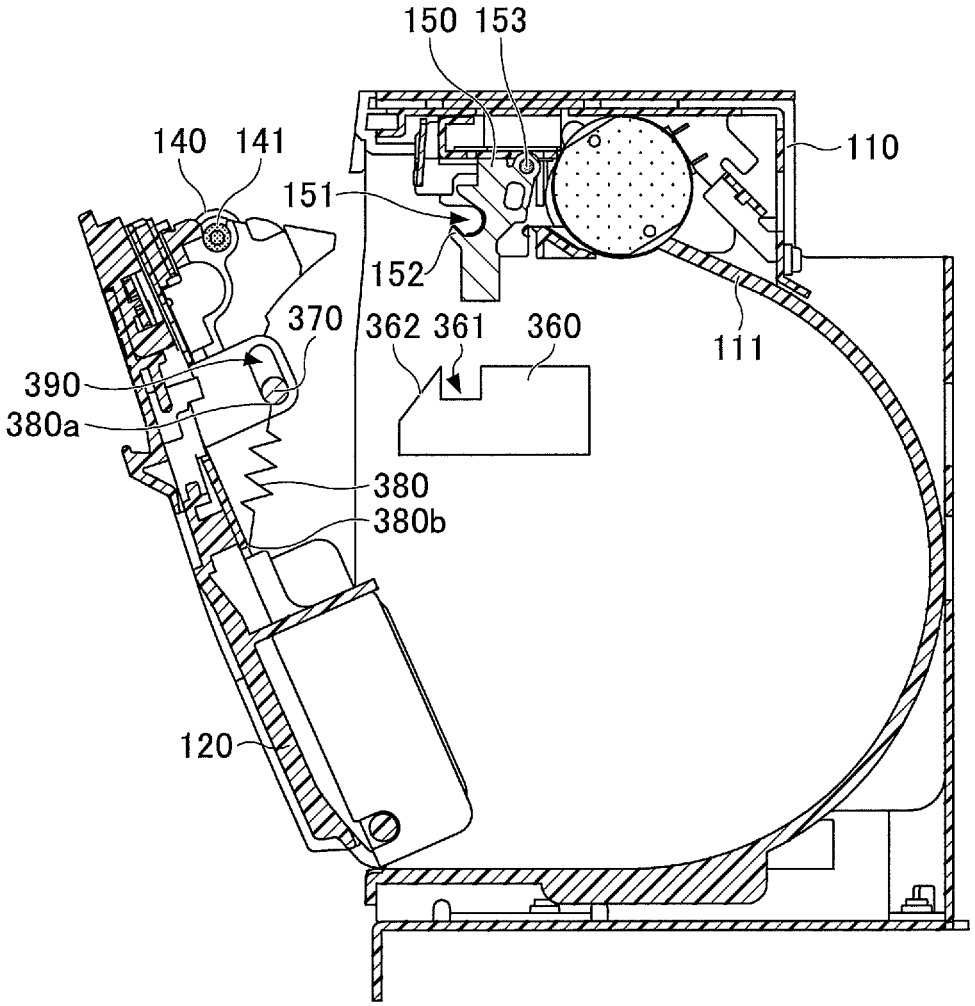
FIG. 18 is a diagram depicting a structure of a printer according to a third embodiment.

Next, a printer according to a third embodiment is described with reference to FIGS. 18 through 21. Referring to FIG. 18, the printer according to this embodiment includes a hook 360 fixed to the interior of the body 110 and a shaft 370 attached to the lid 120 to serve as an engaging part. A recess 361 is formed in the hook 360. The shaft 370 enters the recess 361. The hook 360 includes a slope 362 formed on the lid 120 side of the recess 361. In other words, the slope 362 is positioned closer to the shaft 370 than the recess 361 when the lid 120 is open.

A coil spring 380 is provided between the shaft 370 and the lid 120. A portion of the shaft 370 is placed in an elongated circular groove 390 formed in the lid 120 to be movable inside the groove 390. The coil spring 380 has a first end 380*a* connected to the shaft 370 and a second end 380*b* connected to the lid 120. The coil spring 380 exerts a restoring force in a direction to pull the shaft 370 to a lower end of the groove 390.

Figure 19:
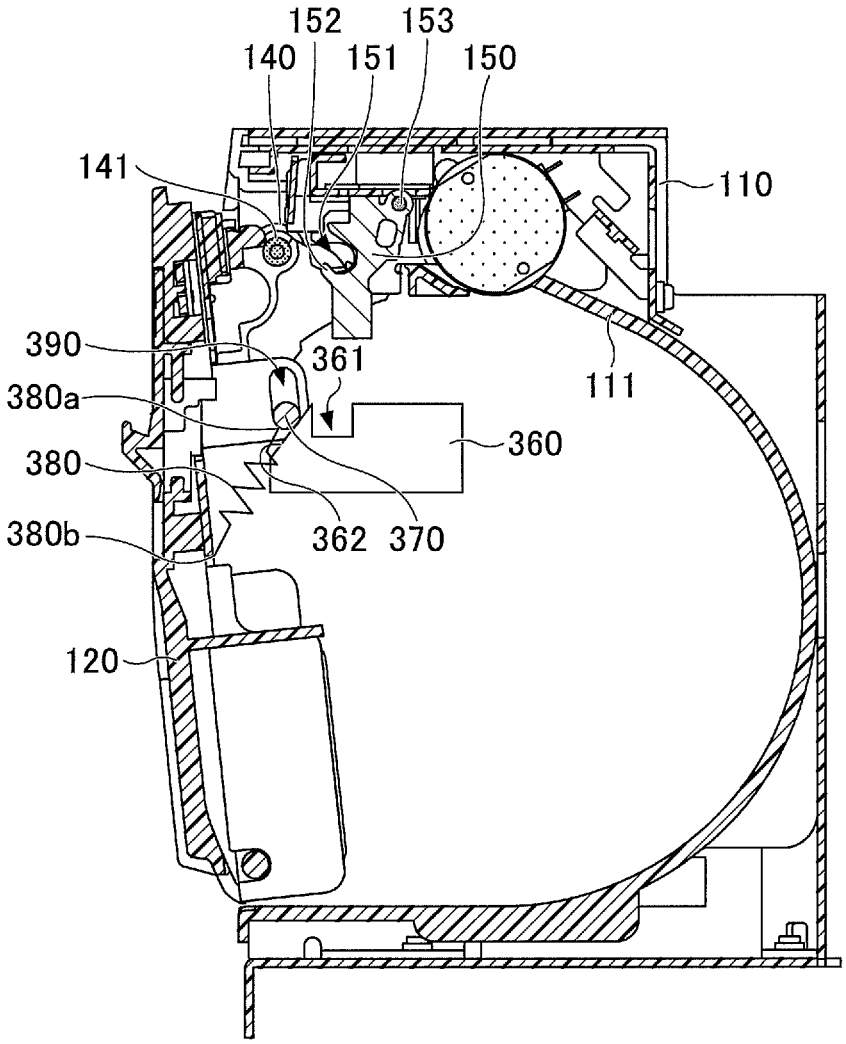
FIG. 19 is a diagram for explaining the printer according to the third embodiment.
Figure 20A:
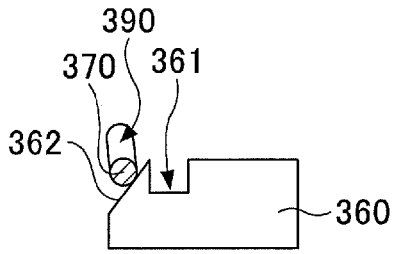
FIGS. 20A through 20D are diagrams for explaining the printer according to the third embodiment.

When the lid 120 is closed from the state depicted in FIG. 18, the lid 120 gets closer to the body 110 as depicted in FIG. 19, so that the shaft 370 contacts the slope 362 as depicted in FIG. 20A. In this state, the platen shaft 141 is out of contact with the platen lock 150.

Figure 20B:
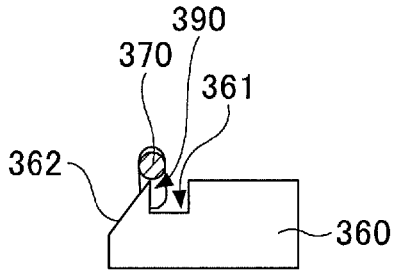

Thereafter, the lid 120 is further closed to cause the shaft 370 to be pressed by the hook 360 against the restoring force of the coil spring 380, so that the shaft 370 moves upward in the groove 390 as depicted in FIG. 20B. At this point, the shaft 370 moves along the slope 362 to the boundary between the slope 362 and the recess 361 as depicted in FIG. 20B. The restoring force of the coil spring 380 maximizes when the shaft 370 is at the position illustrated in FIG. 20B.

Figure 20C:
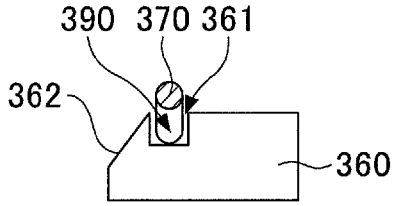
Figure 20D:
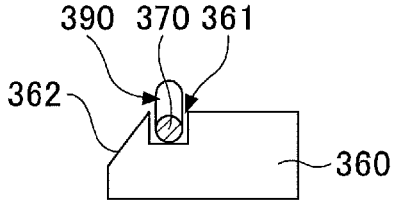
Figure 21:
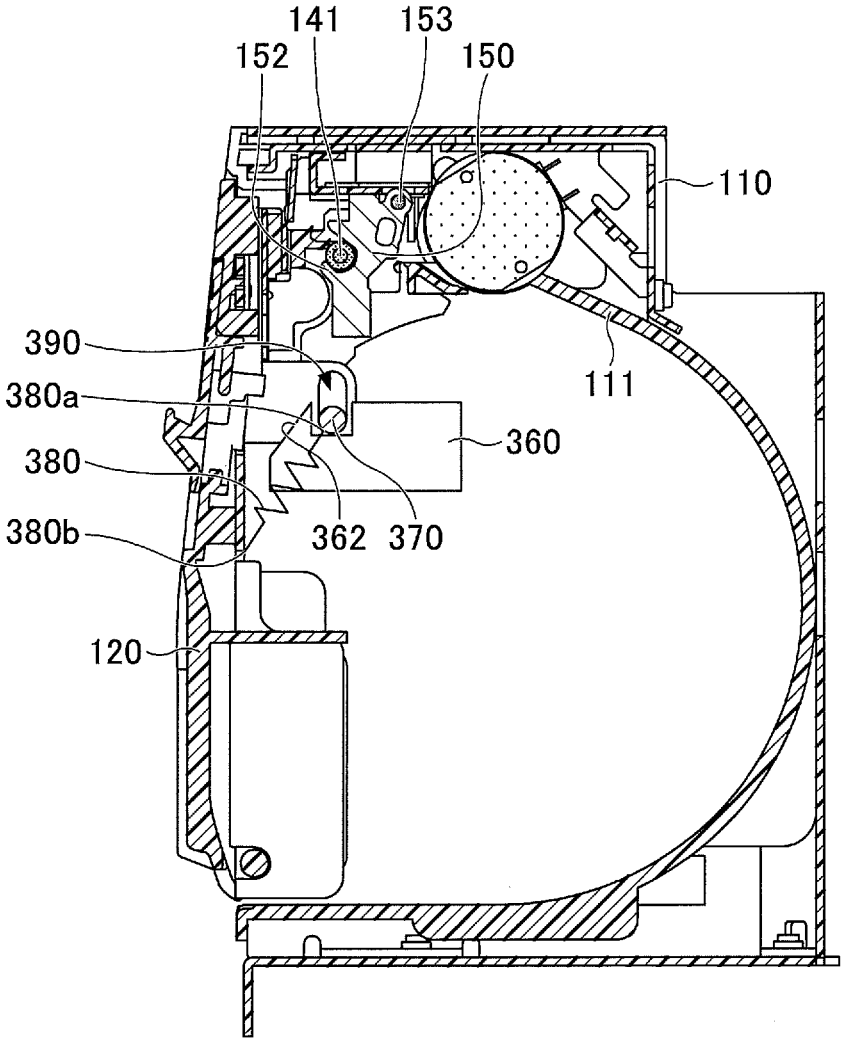
FIG. 21 is a diagram for explaining the printer according to the third embodiment.

Thereafter, the lid 120 is further closed to cause the shaft 370 to leave the slope 362 and move to a position facing the entrance of the recess 361 as depicted in FIG. 20C. As a result, the shaft 370 moves downward in the groove 390 because of the restoring force of the coil spring 380, so that the shaft 370 contacts the bottom of the recess 361 as depicted in FIGS. 20D and 21. According to the printer of this embodiment, a strong clicking sensation can be produced at this point. In the state depicted in FIGS. 20D and 21, the shaft 370 is positioned in the recess 361, and the platen shaft 141 is positioned in the opening 151 to be held by the platen lock 150.

Unlike the platen roller 140, the shaft 370 is not used to convey recording paper. Therefore, pressing the slope 362 with a strong force with the shaft 370 does not cause any trouble in printing. Accordingly, it is possible to increase the restoring force of the coil spring 380 and to control the strength of the clicking sensation to a desired level.

In other respects than those described above, the third embodiment may be the same as the first embodiment.

[d] Fourth Embodiment

Figure 22:
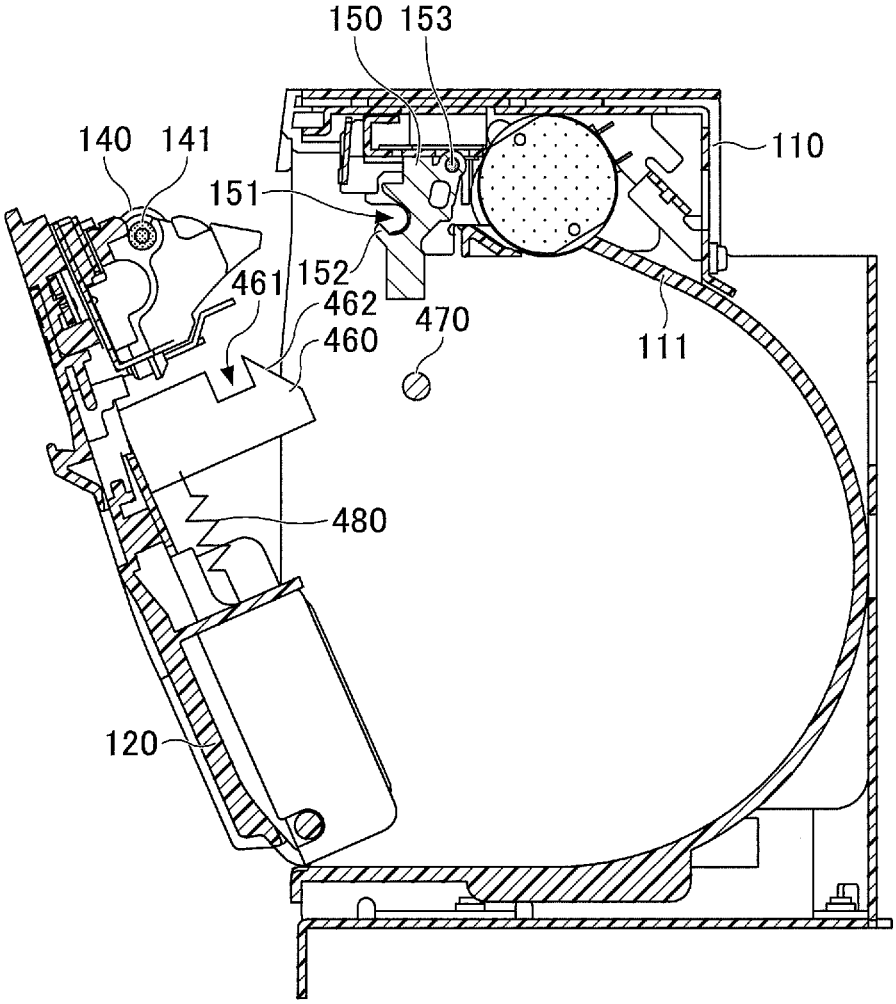
FIG. 22 is a diagram depicting a structure of a printer according to a fourth embodiment.

Next, a printer according to a fourth embodiment is described with reference to FIGS. 22 through 25. Referring to FIG. 22, the printer according to this embodiment includes a shaft 470 attached to the body 110 and a hook 460 movably attached to the lid 120. The shaft 470 is fixed to the body 110 to serve as an engaging part. A recess 461 that accommodates the shaft 470 is formed in the hook 460. The hook 460 includes a slope 462 formed on the shaft 470 side of the recess 461, in other words, the slope 462 is positioned closer to the shaft 470 than the recess 461 when the lid 120 is open.

A coil spring 480 is provided between the hook 460 and the lid 120. The coil spring 480 is connected to the hook 460 and to the lid 120. The hook 460 is movable on and along the lid 120 upward (in a direction away from an end of the lid 120) and downward (in a direction toward the end of the lid 120). The coil spring 480 exerts a restoring force on the hook 460 in a direction to push the hook 460 upward.

Figure 23:
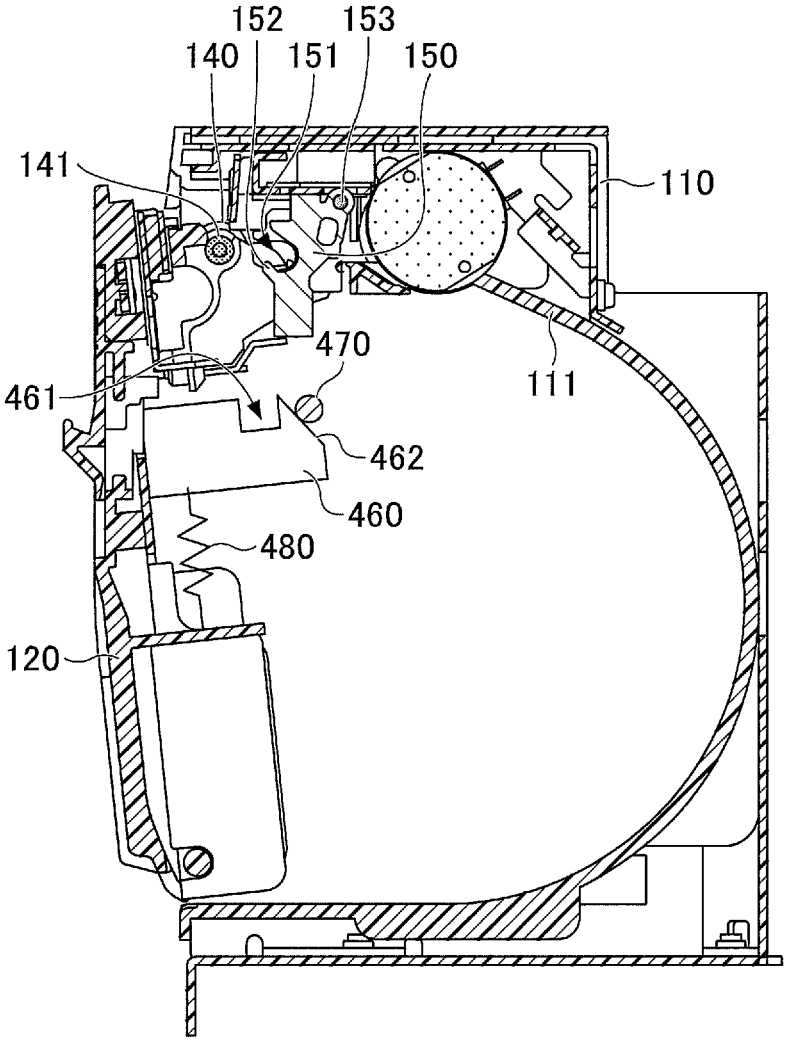
FIG. 23 is a diagram for explaining the printer according to the fourth embodiment.
Figure 24A:
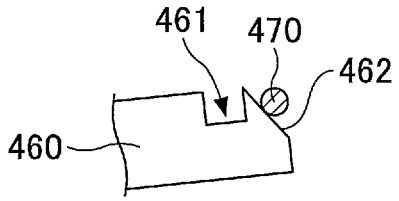
FIGS. 24A through 24D are diagrams for explaining the printer according to the fourth embodiment.

When the lid 120 is closed from the state depicted in FIG. 22, the lid 120 gets closer to the body 110 as depicted in FIG. 23, so that the shaft 470 contacts the slope 462 as depicted in FIG. 24A. In this state, the platen shaft 141 is out of contact with the platen lock 150.

Figure 24B:
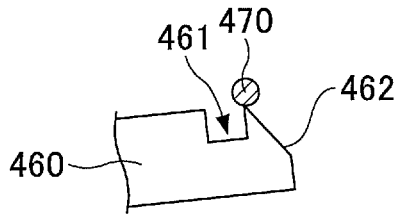

Thereafter, the lid 120 is further closed to cause the shaft 470 to press the hook 460 against the restoring force of the coil spring 480, so that the hook 460 moves downward as depicted in FIG. 24B. At this point, the shaft 470 relatively moves along the slope 462 to the boundary between the slope 462 and the recess 461 as depicted in FIG. 24B. The restoring force of the coil spring 480 maximizes when the shaft 470 is at the position illustrated in FIG. 24B.

Figure 24C:
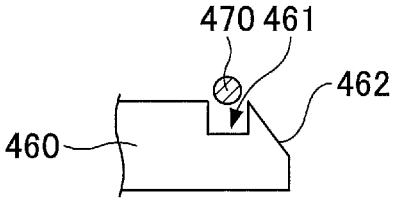
Figure 24D:
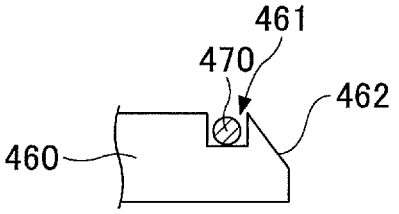
Figure 25:
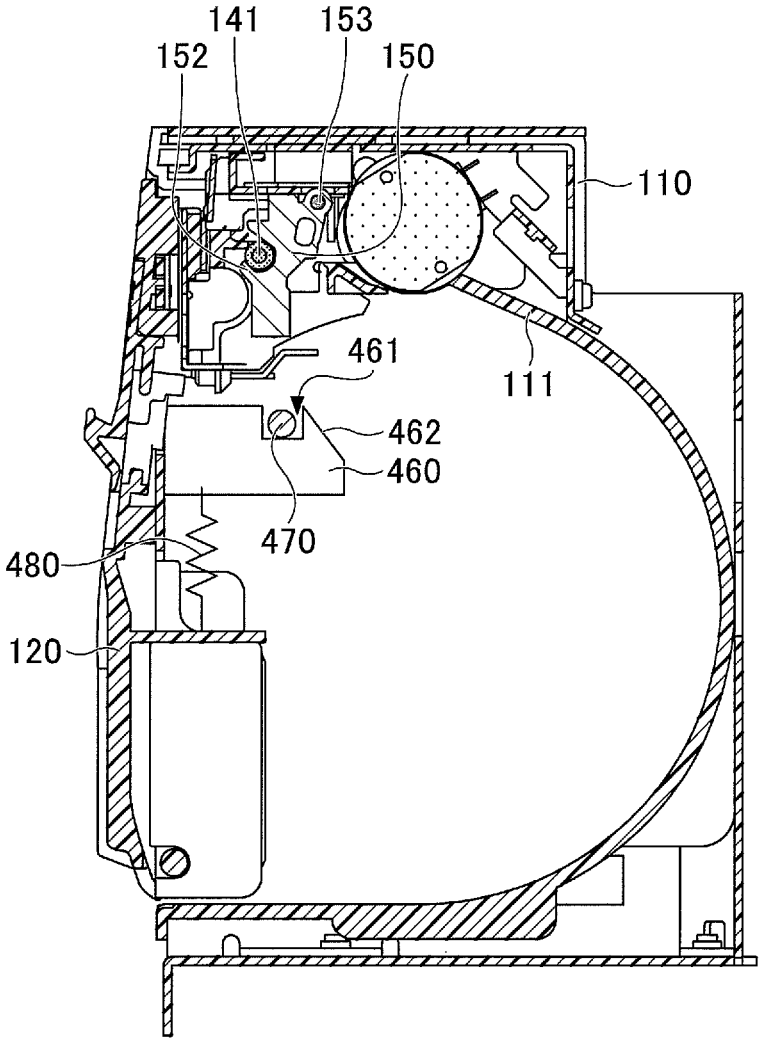
FIG. 25 is a diagram for explaining the printer according to the fourth embodiment.

Thereafter, the lid 120 is further closed so that the shaft 470 leaves the slope 462 to be positioned before the entrance of the recess 461 as depicted in FIG. 24C. As a result, the hook 460 moves upward as biased by the coil spring 480, so that the shaft 470 contacts the bottom of the recess 461 as depicted in FIGS. 24D and 25. According to the printer of this embodiment, a strong clicking sensation can be produced at this point. In the state depicted in FIGS. 24D and 25, the shaft 470 is positioned in the recess 461, and the platen shaft 141 is positioned in the opening 151 to be held by the platen lock 150.

Unlike the platen roller 140, the shaft 470 is not used to convey recording paper. Therefore, pressing the slope 462 of the hook 460 with a strong force with the shaft 470 does not cause any trouble in printing. Accordingly, it is possible to increase the restoring force of the coil spring 480 and to control the strength of the clicking sensation to a desired level.

In other respects than those described above, the fourth embodiment may be the same as the first embodiment.

[e] Fifth Embodiment

Figure 26B:
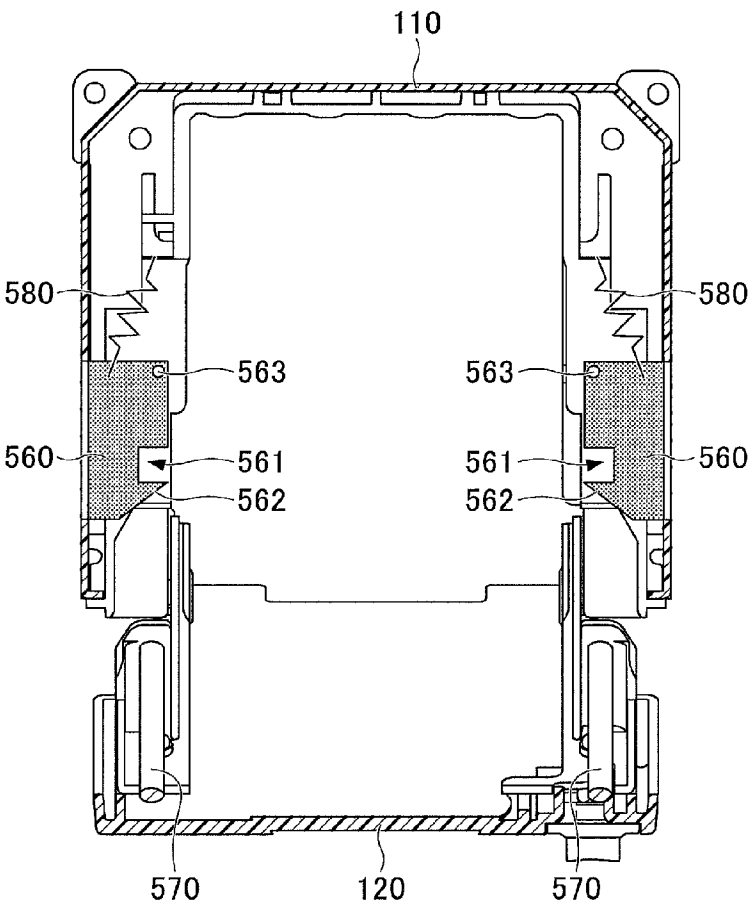
FIGS. 26A and 26B are diagrams depicting a structure of a printer according to a fifth embodiment.
Figure 26A:
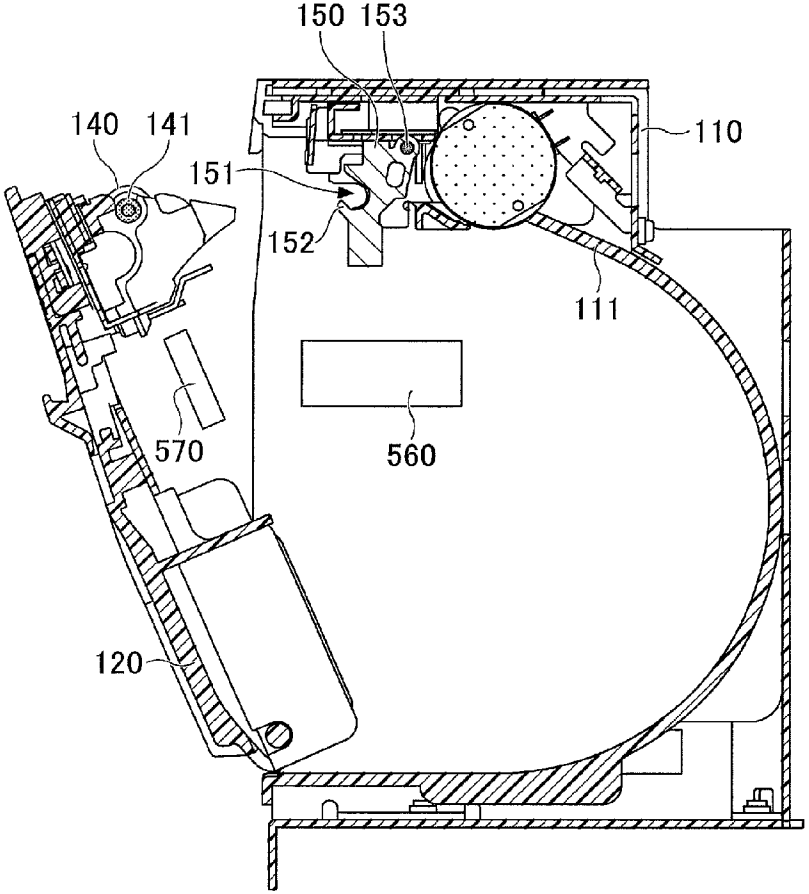

Next, a printer according to a fifth embodiment is described with reference to FIGS. 26A through 28B. Referring to FIGS. 26A and 26B, the printer according to this embodiment includes hooks 560 attached to the body 110 and shafts 570 attached to the lid 120 to serve as an engaging part. FIG. 26A is a cross-sectional view of the printer, taken along a plane perpendicular to a longitudinal direction of the platen roller 140. FIG. 26B is a cross-sectional view of the printer of FIG. 26A, taken along a plane parallel to the bottom of the body 110.

Each hook 560 is provided on one of interior side surfaces of the body 110. Each hook 560 is connected to the body 110 to be pivotable about a corresponding shaft 563. A recess 561 that accommodates one of the shafts 570 is formed in each hook 560. Each hook 560 includes a slope 562 formed on the lid 120 side of the recess 561. A coil spring 580 is provided between each hook 560 and the body 110. Each coil spring 580 is connected to the corresponding hook 560 and to the body 110. Each coil spring 580 biases the corresponding hook 560 to pivot about the shaft 563 in a direction to reduce the interval between the two hooks 560. The following description is given, taking one of the hooks 560 as a typical example of the hooks 560.

Figure 27A:
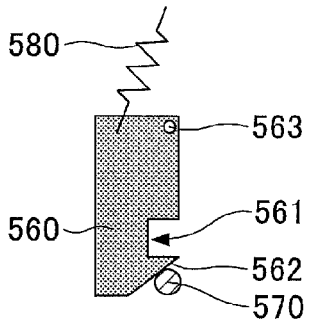
FIGS. 27A through 27D are diagrams for explaining the printer according to the fifth embodiment.

When the lid 120 is closed from the state depicted in FIGS. 26A and 26B, the shaft 570 contacts the slope 562 as depicted in FIG. 27A.

Figure 27B:
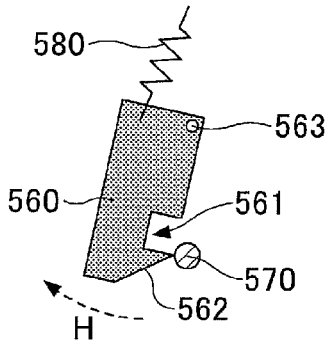

Thereafter, the lid 120 is further closed to cause the shaft 570 to press the hook 560, so that the hook 560 pivots about the shaft 563 in a direction to move the slope 562 away from the other hook 560 as indicated by the dashed arrow H in FIG. 27B. At this point, the shaft 570 moves along the slope 562 to the boundary between the slope 562 and the recess 561 as depicted in FIG. 27B. The restoring force of the coil spring 580 maximizes when the shaft 570 is at this position.

Figure 27C:
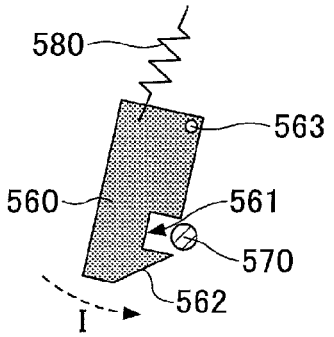
Figure 27D:
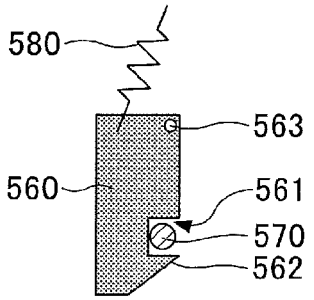
Figure 28B:
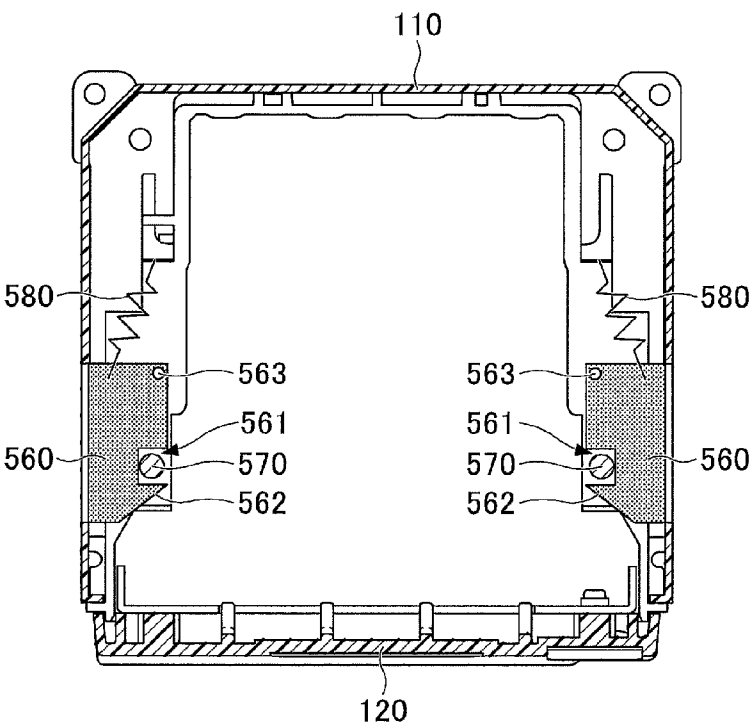
FIGS. 28A and 28B are diagrams for explaining the printer according to the fifth embodiment.
Figure 28A:
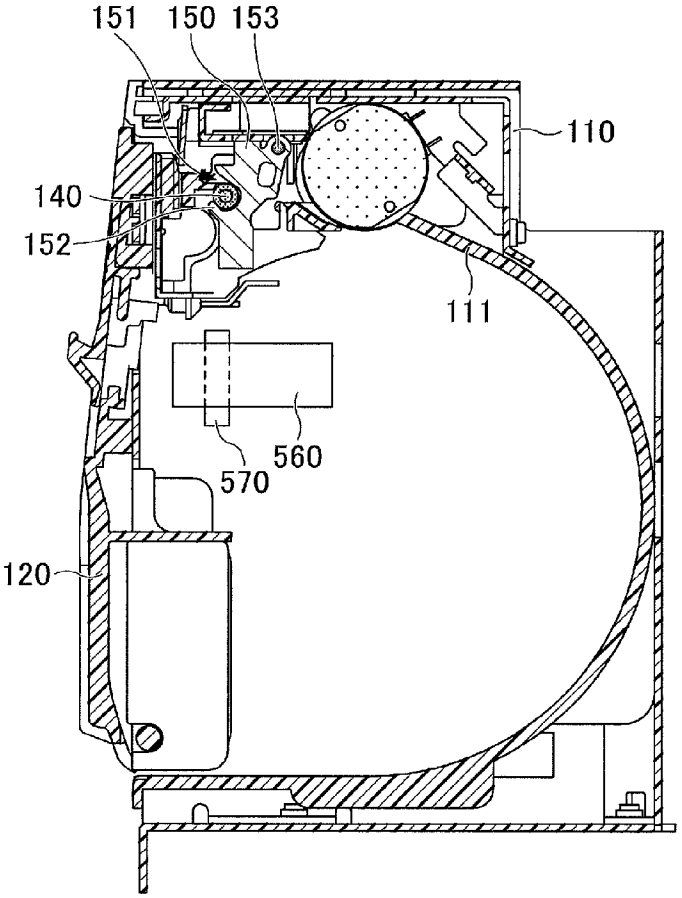

Thereafter, the lid 120 is further closed to cause the shaft 570 to leave the slope 562 and move to the entrance of the recess 561 as depicted in FIG. 27C. As a result, the hook 560 pivots in a direction to move toward the other hook 560 as indicated by the dashed arrow I by the coil spring 580. The hook 560 pivots until the shaft 570 contacts the bottom of the recess 561 as depicted in FIGS. 27D, 28A and 28B. According to the printer of this embodiment, a strong clicking sensation can be produced at this point. In the state depicted in FIGS. 27D, 28A and 28B, the shaft 570 is positioned in the recess 561, and the platen shaft 141 is positioned in the opening 151. FIG. 28A is a cross-sectional view of the printer, taken along a plane perpendicular to the longitudinal direction of the platen roller 140. FIG. 28B is a cross-sectional view of the printer of FIG. 28A, taken along a plane parallel to the bottom of the body 110.

As the shaft 570 is not used to convey recording paper, pressing the slope 562 with a strong force with the shaft 570 does not cause any trouble in printing. Accordingly, it is possible to increase the restoring force of the coil spring 580 and to control the strength of the clicking sensation to a desired level.

In other respects than those described above, the fifth embodiment may be the same as the first embodiment.

In the above-described embodiments, a mechanism for providing a clicking sensation, for example, components such as the hook 160 and the shaft 170 in the first embodiment, may also be provided on the side of the printer opposite to the side depicted in the drawings.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a body including a holder configured to accommodate recording paper;

a lid attached to the body to be opened and closed relative to the body;

a hook including a recess; and an engaging part configured to engage with the hook, wherein the hook is attached to the body with the engaging part attached to the lid, or the hook is attached to the lid with the engaging part attached to the body, and wherein the engaging part is accommodated in the recess of the hook to engage with the hook when the lid is closed relative to the body.

2. The printer as claimed in claim 1, wherein the hook includes a slope positioned closer to the engaging part than the recess when the lid is open, and the engaging part contacts the slope to press and move the hook when closing the lid.

3. The printer as claimed in claim 1, wherein the hook is movably attached to the body or the lid.

4. The printer as claimed in claim 1, further comprising:

a platen roller; and a platen lock configured to hold the platen roller when the lid is closed, wherein the platen roller is attached to the body with the platen lock attached to the lid, or the platen roller is attached to the lid with the platen lock attached to the body.

5. The printer as claimed in claim 1, wherein the hook is biased in a direction to accommodate the engaging part in the recess.

6. The printer as claimed in claim 1, wherein the hook includes a slope positioned closer to the engaging part than the recess when the lid is open, and the engaging part contacts the slope to be pressed by the slope to move when closing the lid.

7. The printer as claimed in claim 1, wherein the engaging part is biased in a direction to be accommodated in the recess.

8. A printer, comprising:

a body including a holder configured to accommodate recording paper;

a lid attached to the body to be opened and closed relative to the body;

a hook including a recess; and an engaging part configured to engage with the hook, wherein the hook is attached to the body with the engaging part attached to the lid, or the hook is attached to the lid with the engaging part attached to the body, wherein the engaging part is accommodated in the recess of the hook to engage with the hook when the lid is closed relative to the body, and wherein the hook is biased in a direction to accommodate the engaging part in the recess.

9. The printer as claimed in claim 8, further comprising:

a platen roller; and a platen lock configured to hold the platen roller when the lid is closed, wherein the platen roller is attached to the body with the platen lock attached to the lid, or the platen roller is attached to the lid with the platen lock attached to the body.

10. The printer as claimed in claim 8, wherein the hook includes a slope positioned closer to the engaging part than the recess, and the engaging part contacts the slope to press and flex the hook when closing the lid.

* * * * *